United States Patent [19]

Cave

[11] Patent Number: 4,879,942

[45] Date of Patent: Nov. 14, 1989

[54] MUZZLE BRAKE WITH IMPROVED STABILIZATION AND BLAST CONTROL

[76] Inventor: James B. Cave, Rt. 2 Box 2400, Bulverde, Tex. 78163

[21] Appl. No.: 658,839

[22] Filed: Oct. 9, 1984

[51] Int. Cl.[4] ..... F41C 21/18

[52] U.S. Cl. ..... 89/14.3

[58] Field of Search ..... 89/14.2, 14.3, 14.4, 89/14.6

[56] References Cited

U.S. PATENT DOCUMENTS

| | | | |
|---|---|---|---|
| 1,259,251 | 3/1918 | Love | 89/14.3 |
| 1,429,619 | 9/1922 | Nelson | 89/14.3 |
| 1,636,357 | 7/1927 | Cutts | 89/14.3 |
| 2,206,568 | 7/1940 | Hughes | 89/14.3 |
| 2,499,428 | 3/1950 | Tiffany | 89/14.3 |
| 2,667,815 | 2/1954 | Strong | 89/14.3 |
| 3,021,633 | 2/1962 | Beretta | 89/14.3 |
| 3,152,510 | 10/1964 | Ashbrook et al. | 89/14.3 |
| 3,155,003 | 11/1964 | Ruth | 89/14.3 |
| 3,492,912 | 2/1970 | Ashbrook | 89/14.3 |
| 4,341,283 | 7/1982 | Mazzanti | 89/14.4 |

FOREIGN PATENT DOCUMENTS

| | | | |
|---|---|---|---|
| 333851 | 9/1936 | Italy | 89/14.6 |
| 8500215 | 1/1985 | PCT Int'l Appl. . | |
| 6680 | of 1909 | United Kingdom | 89/14.4 |
| 454533 | 10/1936 | United Kingdom | 89/14.3 |

*Primary Examiner*—Stephen C. Bentley

*Attorney, Agent, or Firm*—Jim Zegeer

[57] ABSTRACT

A muzzle brake having improved recoil, stabilization and blast control is comprised of a one-piece housing member securable to the muzzle end of a gun barrel and cone-shaped closure member with a relatively long outlet passage. A spent gas bulk head formed integrally with the tubular housing member is positioned a short distance from the barrel muzzle and has a bullet passage therein which is 50 percent longer than prior art passages for better stabilization. Spent gas vents in the first and second chambers causes significantly more spent gases to be vented to the atmosphere before the bullet leaves the muzzle brake and, at the same time, provides better stabilization, concussion and blast control. Spent gas vents in the first chamber are on the top side and angulated away from the muzzle to control the direction of the muzzle blast and concussion away from the shooter and avoid kicking up dirt or sand when shooting from a prone position. The long first and second bullet passages in the bulk head and in the closure member have slightly larger internal bore diameters relative to the bullet so as to allow for more misalignment tolerance of the muzzle brake with existing threads on a barrel. Slots opening to the atmosphere on the larger second chamber are transverse to the longitudinal axis of the brake which permits larger openings for venting spent gas and also provides better control of gun muzzle.

5 Claims, 1 Drawing Sheet

MUZZLE BRAKE WITH IMPROVED STABILIZATION AND BLAST CONTROL

BACKGROUND AND BRIEF DESCRIPTION OF THE INVENTION

It is well known in the art that the recoil of a gun is the result of two separate and distinct actions: the reaction due to the forward propulsion of the bullet itself and, upon the bullet reaching the muzzle end of the barrel, there is a further reaction due to instantaneous friction release between the bullet and gun barrel and the expansion of the gases exiting from the muzzle end of the barrel and, at least momentarily, at a velocity higher than the muzzle velocity of the bullet. However, because the time it takes for the bullet to travel from the breech end to the muzzle end of the barrel is relatively short, particularly in pistols or small arms, the recoil action due to the above factors is, to the shooter, essentially one. There has been much effort directed in the past towards producing muzzle brakes which reduce weapon recoil by controlling spent gases and such devices essentially fall into what may be categorized in two broad groups: those which seek to utilize the energy of the expanding gases which normally would produce a recoil to produce opposite reaction such as is disclosed in British Patent 454,533 and, in a second category, those devices in which the energy of the expanding gases is absorbed or dissipated interiorally of the muzzle brake so that what gases do escape through the muzzle end or downstream end of the weapon do not cause significant recoil such as Ashbrook Patent 3,492,912, and Tiffany Patent 2,499,428. While in some of these patents and the latter category have vents for venting gases to the atmosphere, they basically seek to achieve recoil reduction by providing surfaces interiorally of the brake for causing the expanding gases to swirl and impinge upon the themselves or on surfaces to cause a reaction opposing recoil or by providing large sound muffling chambers where the passage of the gases through the device is retarded by impingement or baffle walls. Others have compensators or muzzle brakes which have sophisticated shapes or structures which provide both recoil and sound absorbing features such as in Love Patent 1,259,251 and Strong Patent 2,667,815. Ruth Patent 3,155,003, operates on the theory of two different kinds or two types of gases created during the explosion of a propellant charge and seeks to provide a structure which deals with both types of gases in somewhat different ways.

In PCT Application Ser. No. PCT/US83/00984 there is disclosed an improved muzzle brake and the present application is a significant improvement on the device disclosed in that PCT application and the claims appended hereto are made in relation to that device.

As used herein, the term "spent" gas refers to those gases and burned, burning and unburned powder particles which escape from the muzzle after the bullet has separated from the muzzle of the gun.

Muzzle brakes according to the present invention include a tubular housing member which is an integral body preferrably cylindrical but not necessarily so. One end is bored with a relatively small diameter bore for a short distance into the body to form a first relatively small gas expansion chamber. The opposite end of the cylindrical body is bored with a substantially larger diameter bore to form a second volumetrically larger chamber which is substantially coaxial with the first volumetrically smaller chamber. This small diameter bore is of a short depth and terminates in spent gas impingement wall SB. The two chambers are separated by a relatively thick portion through which a bullet passage is bored and at a diameter which is at a predetermined degree larger than the bullet diameter. This middle bullet passage is approximately 50 percent longer than the one disclosed in the above PCT application and provides better stabilization. Since the bore diameter is larger relative to the bullet than in said PCT application, this longer passageway serves as a gas attenuator during and after the passage of the bullet from the volumetrically small chamber to the volumetrically large chamber, keeping in mind that the purpose of this invention is take advantage of the fact that the expanding gases have particles traveling at a higher velocity as they exit the muzzle than the bullet and therefore have, in the absence of thus muzzle brake, overtaken the bullet. A plurality of angulated apertures are formed in the upper half of the volumetrically small chamber and angled away from the muzzle barrel and the shooter and are of a size to accomodate the gases and serve to prevent the spent gases from kicking up dirt or sand in the face of the shooter while shooting from a tripod or prone position.

A plurality of tranverse slots are also formed in the upper surface of the body member in the volumetrically larger downstream chamber and these slots are made transverse to the longitudinal axis of the gun and provide larger openings for venting spent gas and, in conjunction with the openings in the volumetrically smaller chamber, provide better control and in the elimination of muzzle jump. Finally, the interior wall of the volumetrically larger chamber is threaded for threadably receiving the second component of the device, namely, a cone-shaped end or closure member which has, significantly, a very long bullet outlet passage which is of the same diameter as the middle bullet passage and thereby reducing manufacturing costs without sacrificing recoil reduction properties. This doubling of the length of the downstream bullet outlet passage causes significantly more of the spent gases to be vented to the atmosphere before the bullet leaves the muzzle brake. By the time the bullet has entered and fully traversed said outlet passage, substantially all spent gases will have been vented through the apertures. This results in better stabilization of the weapon and directing more of the blast away from the shooter when shooting from the hip position. Prior to the present invention, the shooter felt more of the concusion.

Accordingly, the object of the present invention is to provide an improved muzzle brake and more particularly, a muzzle brake having improved recoil reduction, stabilization and jump properties and, at the same time, having improved blast control properties directing the concusion and blast products away from the shooter.

BRIEF DESCRIPTION OF THE DRAWINGS

The above and other objects, advantages and features of the invention will become more apparent when considered with the following specification and appended drawings wherein.

DETAILED DESCRIPTION OF THE INVENTION

Figure 1:
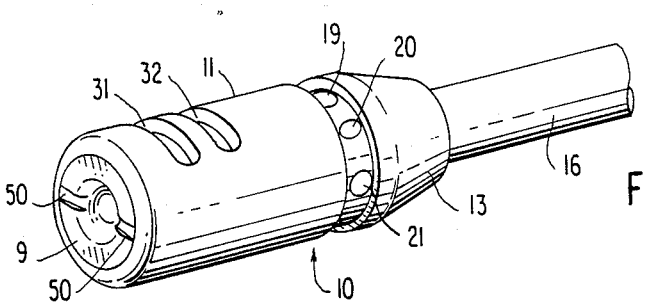
FIG. 1 is an isometric prospective view of a muzzle brake incorporating the invention.
Figure 2:
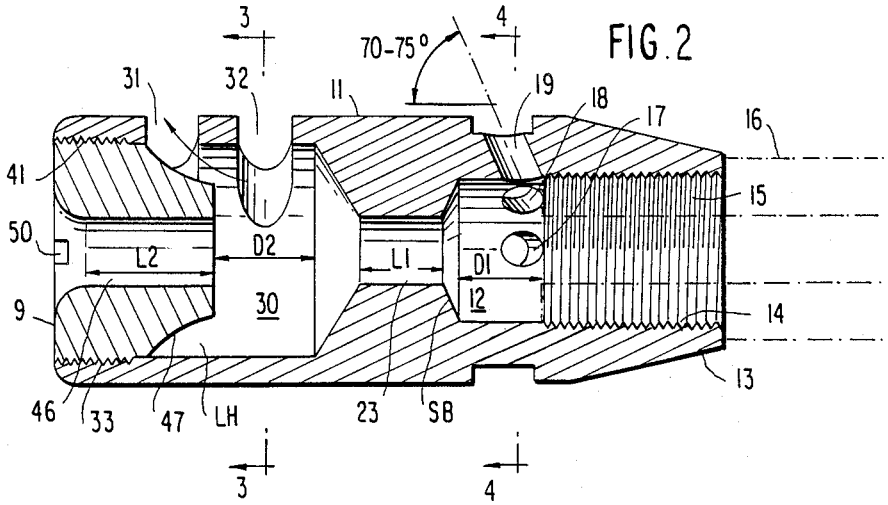
FIG. 2 is a vertical sectional view along the longitudinal axis of the brake shown in FIG. 1.
Figure 3:
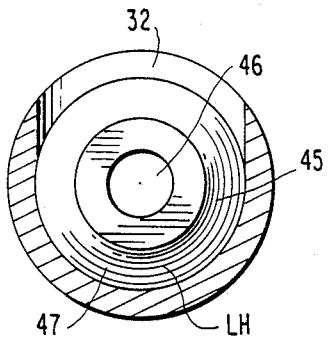
FIG. 3 is a sectional view through lines 3—3 of FIG. 2.
Figure 4:
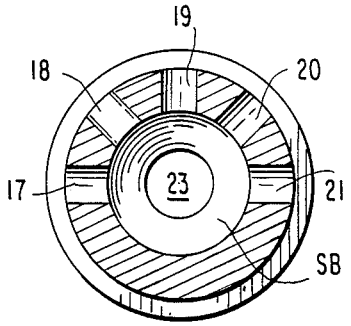
FIG. 4 is a cross-sectional view on lines 4—4 of FIG. 2.

As shown in FIGS. 1-4 of the drawings, muzzle brake 10 is essentially a two component device consisting of a main body member 11 and a muzzle head 9. The body member 11 is a single solid piece of metal and while it may be formed by castings is, in the present invention formed by simple machining operations, the order of which is not particularly relevant. A first bore hole 12 is formed in the muzzle end 13 of body member 11 and tapped or threaded internally as at 14 to be received upon the correspondingly threaded muzzle end 15 of a gun barrel 16, but it will be appreciated that the particular type of mounting means for the muzzle brake upon the barrel of a weapon can be selected from a wide variety. A plurality of vent holes 17, 18, 19, 20 and 21 are formed in the upper half of the body member 11 and communicate with the interior bore hole or chamber 12. Vent holes 17-21 (there may be more or less number), are angulated at an angle of 70 to 75 degrees in a direction to cause exiting gases to be directed away from the muzzle end 15 of gun barrel 16 and hence away from the shooter.

Spent gas bulkhead or wall surface SB is only a very short distance from the end of the muzzle 15 so that as soon as the bullet disengages from the muzzle (e.g. frictional forces released), the expanding spent gases impinge thereupon at their maximum forward energy and create a reaction force opposing recoil actions the escaping gas impinges on the interior gas impingement member 5B to transfer the maximum kinetic energy of said spent gas to attenuate recoil. When this wall is a further distance from the gun barrel, the kinetic energy of the spent gas is less, so that recoil attenuation is less. Moreover, a component of the reaction force of these gases leaving serves to attenuate or eliminate muzzle jump (which is, per se, a known feature as is disclosed in the prior art referred to above). However, there is a relationship between the gases exiting through vent holes 17-21 and the length of the middle bullet passage 23. Middle bullet passage 23 is bored to be slightly larger in diameter than the bullet and this passageway 23 is of such a length that when the trailing edge of the bullet has emerged or just disengaged from the muzzle barrel 15 (so that the frictional forces retarding the bullets are no longer effective) and the expanding gases has begun to accelerate from the muzzle end 15 into the volumetrically small chamber 12, the nose or leading edges of the bullet is entering or within the middle passage 23. As will be explained more fully hereafter, the length of the middle passage is made significantly long, particularly in relation to the prior art so that more of the expanding gases tend to pass through the vents 17-21 to reduce muzzle jump and control concussion.

The end 28 of body member 11 opposite the muzzle end 13 is bored with a substantially larger bore to form a second, and volumetrically larger downstream chamber 30. In this embodiment, a plurality of transverse slots 31 and 32 which are orthogonal to the longitudinal axis of the gun barrel and the body member 11.

The forward end of reverse funnel member 9 is smoothly rounded and provided with a pair of slots 50 for inserting a tool to unthread the reverse funnel member if desired. The device is basically self-cleaning, and is easily cleaned merely by soaking in a solvent.

The interior end 33 of the bore forming chamber 30 is threaded for receiving correspondingly threaded exterior of the second component of this muzzle brake, namely, the outlet cone or reverse funnel member or muzzlehead 9. Reverse funnel member 9 has a threaded portion 41 engaging threads 33 and a tapering sides or conical portion 45 which, as will be described hereafter, serves two functions, namely, the turbulation of the gases on the lower half LH of the chamber 30 and the directing or control of gases exiting on the upper half through transverse slot 31 and partially through transverse slot 32. An important feature of the invention is the length of the outlet bullet passage 46. Outlet bullet passage 46 is essentially the same diameter as internal bore 23 of the middle passage and is essentially, in the preferred embodiment substantially double the length of the outlet passage disclosed in said PCT application and the prior art. Since the first and second chambers 12 and 30 are both volumetrically small, the length of the outlet passage 46 permits significantly more of the spent and expanding gases to be exhausted from the device in a direction transverse to the direction of bullet travel. There is an enhancement in the stabilization effect of the gun, reduction in muzzle jump by a controlled directionality given to the exhaust of gases from the muzzle brake achieved. Since the outlet passage is quite long, in relation to the prior art, substantially all spent gas exits the second chamber through the transverse slots. Thus, by the time the bullet has entered and fully traversed said outlet passage, substantially all spent gases will have been vented through the apertures. Those gases exiting through middle passageway behind the bullet or, in front of the bullet, and are on the lower half LH of the chamber 30 engage conical surface 47 and are turbulated thereby so that the energy is spent or dissipated, and at the same time, a small component of forward force is created to further attenuate recoil action. Thus, according to the present invention, the advantages of attenuating recoil by eliminating or absorbing the energy of the expanding gases by baffle members having impingement on surfaces transverse to the direction of travel so as to create reaction forces opposite the direction of recoil is achieved. At the same time, the invention assures that those gases which do escape are utilized most efficiently to control muzzle jump, reduce the blast and concussion effects on the shooter. The diameter of the middle passage and the outlet passage are preferrably the same so as to reduce manufacturing costs without sacrificing recoil reduction. The middle passage is longer so as to offset the larger bore diameter thereof and in this respect, gives the same effect as a smaller diameter in previous brakes but with better stabilization. That is, in the brake shown in the PCT application referred to above, the diameter was made small relative to the outlet passage so as to better contain the gases in the first volumetrically smaller chamber during the traversal of the bullet therethrough. In the present invention, the diameter is open somewhat so as to permit some small degree of tolerances for misalignment and, at the same time, assure that because the gases have a longer path to travel during the time the bullet is transiting the middle passage that they are still caused to exit more through the angulated passages 17-21.

For a 0.223 caliber bullet, exemplary approximate dimensions are as follows:

| | | |
|---|---|---|
| Length of bullet passage 23 | 4/15" | (7 mm) |
| Diameter of bullet passage 23 | 3.5/15" | (6 mm) |
| Length of bullet passage 46 | 6.5/15" | (11 mm) |
| Diameter of bullet passage 46 | 3.5/15" | (6 mm) |
| Diameter of chamber 12 | 7/15" | (12 mm) |
| Diameter of chamber 30 | 11/15" | (20 mm) |
| Distance from muzzle to upstream end of bullet passage 23 | 4/15" | (7 mm) |
| Distance from upstream end of bullet passage 46 to downstream end of bullet passage 23 | 7.5/15" | (13 mm) |

While there has been shown and described a preferred embodiment of the invention, it will be appreciated that various modifications and adaptations of the invention will be apparent to those skilled in the art, it is intended that all such modifications and adaptations be included within the true spirit and scope of the claims appended hereto:

What is claimed is:

1. In a muzzle brake having a one-piece housing member including means for securing said muzzle brake to the muzzle end of a gun, said gun having a gun bore diameter, said one-piece housing member having an integral first interior spent gas impingement member with a central bore therethrough through which a bullet passes and defining first and second chambers, said first chamber being contiguous to said muzzle and volumetrically smaller than said second chamber and a closure member being threadably secured to the end of said housing member opposite the muzzle end, said closure member having a bullet outlet passage and aligned with said central bore and a reverse cone shape, and a plurality of apertures in said first and said second chambers for venting spent gas to ambient, the improvement wherein:

the combined length of said bullet outlet passage and said central bore being greater than three times the diameter of said gun bore diameter, said apertures in the volumetrically small chamber being formed of circular bores which are angled away from the muzzle of said gun and are all located in the upper half of said housing member at an angle of between 70 and 75 degrees to the longitudinal axis thereof to prevent spent gases from kicking-up loose debris in the face of a shooter while shooting from a prone position, and said outlet passage and central bore being of the same diameter, said central bore being of a length at least equal to the diameter of said bore diameter to improve stabilization and attenuate gas passage therethrough during traversal thereof by said bullet.

2. The invention defined in claim 1 wherein said apertures in said second chamber are slots which are transverse to the longitudinal axis and having a cross-sectional area to better control muzzle jump.

3. The invention defined in claim 1 wherein the distance from said muzzle end to said first interior gas impingement member is short such that escaping gas impinges thereupon to transfer the maximum kinetic energy of said spent gas to said first interior impingement member and thereby attenuate recoil.

4. A two-part muzzle brake assembly having as one part an integral one-piece housing member having means for securing said muzzle brake to the muzzle end of a gun having a gun bore diameter, said housing member having a first interior spent gas impingement member with a central bore therethrough through which the bullet passes and defining first and second chambers, said first chamber being volumetrically smaller than said second chamber, said second chamber being formed by a large cylindrical bore extending from the muzzle end of said housing member to said spent gas impingement member and said first chamber is formed by a substantially smaller, cylindrical bore in the opposite end of said housing member and coaxially aligned with said large cylindrical bore, said bullet outlet passage and said central bore, and as a second part of said two-part muzzle brake, a closure member threadably secured in the end of said housing member opposite the muzzle end, said closure member having a bullet outlet passage aligned with said central bore, said central bore being substantially longer than 6/32 inch to improve stabilization of said gun, a plurality of apertures formed in said first and said second chambers, said bullet outlet passage having a length of about twice said gun bore diameter so that by the time a bullet has entered and fully traversed said outlet passage, substantially all spent gases will have been vented through said apertures, the distance from said muzzle end to said first interior gas impingement member being relatively short and equal to about said gun bore diameter such that escaping gas impinges thereupon to transfer the maximum kinetic energy of said spent gas to said first interior impingement member and thereby attenuate recoil, said apertures in said first chamber are angled away from the muzzle end of said gun at an angle of between 70 and 75 degrees to the longitudinal axis thereof, said apertures in said second chamber are slots which are transverse to the longitudinal axis to better control muzzle jump, said closure member being a cone member having a reverse cone-shaped surface and the base of said reverse cone-shaped surface is aligned with one of said transverse slots.

5. In a muzzle brake having a one-piece housing member having means for securing said muzzle brake to the muzzle end of a gun, said one-piece housing member having a first interior spent gas impingement member with a central bore therethrough through which the bullet passes and defining first and second chambers, said first chamber being volumetrically smaller than said second chamber and having a diameter about double the diameter of said central bore and said second chamber having a diameter about three times the diameter of said central bore, and a closure member in the end of said housing member opposite the muzzle end said closure member having a reverse cone shape and a bullet outlet passage aligned with said central bore, and a plurality of apertures in said first and said second chambers, said first chamber having a plurality of circular apertures all located on the upper half of said one-piece housing, said circular apertures being angled away from the muzzle end of said gun at an angle between 70 and 75 degrees to the longitudinal axis of said first chamber, one or more slot apertures in said second chamber, said one or more slots being transverse to the longitudinal axis to better control muzzle jump, said bullet outlet passage having a length substantially greater than the length of said central bore so that by the time the bullet has entered and fully traversed said outlet passage, substantially all spent gases will have been vented through said apertures, said central bore being longer than the diameter of said central bore to improve stabilization of said weapon, the distance from said muzzle end to said first interior gas impingement member is short such that escaping gas impinges thereupon to transfer the maximum kinetic energy of said spent gas to said first interior impingement member and thereby attenuate recoil.

* * * * *